US011781340B2

(12) United States Patent
Xiang et al.

(10) Patent No.: US 11,781,340 B2
(45) Date of Patent: Oct. 10, 2023

(54) LOCKING DEVICE

(71) Applicant: Dezhao Xiang, Shenzhen (CN)

(72) Inventors: Dezhao Xiang, Shenzhen (CN); Qiuzhi Yang, Shenzhen (CN)

( * ) Notice: Subject to any disclaimer, the term of this patent is extended or adjusted under 35 U.S.C. 154(b) by 355 days.

(21) Appl. No.: 16/451,015

(22) Filed: Jun. 25, 2019

(65) Prior Publication Data

US 2019/0390478 A1 Dec. 26, 2019

(30) Foreign Application Priority Data

Jun. 26, 2018 (CN) ..... 201820990324.8
Oct. 26, 2018 (CN) ..... 201821749267.0

(51) Int. Cl.
*E05B 13/00* (2006.01)
*E05B 1/00* (2006.01)
(Continued)

(52) U.S. Cl.
CPC ..... *E05B 13/004* (2013.01); *E05B 1/003* (2013.01); *E05B 13/005* (2013.01);
(Continued)

(58) Field of Classification Search
CPC ..... E05B 15/00; E05B 15/0013; E05B 2009/046; E05B 2015/042; E05B 3/00; E05B 3/003; E05B 3/065; E05B 33/00; E05B 1/003; E05B 13/0034; E05B 3/06; E05B 3/08; E05B 3/10; E05B 2003/06; E05B 2003/006; E05B 1/00; E05B 1/0007; E05B 1/0053; E05B 1/04; E05B 2001/0076; E05B 15/04; E05B 15/0033; E05B 2015/0437; E05B 2015/0441; E05B 2015/0462; E05B 2015/0496; E05B 13/005; E05B 13/007; E05B 13/10; E05B 13/101; E05B 15/004; E05B 13/002; E05B 13/004; E05B 13/106; E05B 13/108; Y10S 70/02;
(Continued)

(56) References Cited

U.S. PATENT DOCUMENTS 1,989,928 A * 2/1935 Jacobi ..... E05B 13/101 292/228
4,300,374 A * 11/1981 Mullich ..... E05B 27/00 70/389
(Continued)

FOREIGN PATENT DOCUMENTS

CN 106121379 A * 11/2016 ..... E05B 47/0012

*Primary Examiner* — Christine M Mills
*Assistant Examiner* — Peter H Watson

(57) ABSTRACT

A locking device comprises a latch, a spindle and a rotary assembly. The latch is fixed to an object to be locked for engaging with a bore of a strike; the latch has a bolt which locks the object. One end of the spindle is detachably connected to the latch to drive the bolt to move towards or away from the bore. The rotary assembly is disposed at the other end of the spindle, which comprises a cylinder body and a rotary body, the cylinder body is rotated by the rotary body as it rotates, wherein one end of the rotary assembly is provided with a spindle driving means engaged with the other end of the spindle to drive the spindle to rotate. The rotary assembly drives the spindle to rotate via the spindle driving means, and the spindle drives the bolt to move approaching the bore to realize locking.

8 Claims, 6 Drawing Sheets

(51) Int. Cl.
*E05B 15/00* (2006.01)
*E05B 15/04* (2006.01)
*E05B 9/04* (2006.01)

(52) U.S. Cl.
CPC ..... *E05B 15/004* (2013.01); *E05B 15/0033* (2013.01); *E05B 15/04* (2013.01); *E05B 2009/046* (2013.01)

(58) Field of Classification Search
CPC .... Y10S 292/52; Y10S 292/54; Y10S 292/61; Y10S 292/64; Y10S 292/62; Y10S 70/42; E05C 1/08; E05C 1/12; E05C 1/16; E05C 1/163; Y10T 70/7706; Y10T 70/7712; Y10T 70/7718; Y10T 70/7723
See application file for complete search history.

(56) References Cited

U.S. PATENT DOCUMENTS 5,010,749 A * 4/1991 Lin ..... E05B 63/0017 70/381
5,186,030 A * 2/1993 Lin ..... E05B 63/0017 70/381
5,199,285 A * 4/1993 Lin ..... E05B 13/101 70/381
5,544,507 A * 8/1996 Lin ..... E05B 35/08 70/277
5,564,296 A * 10/1996 Theriault ..... E05B 55/005 292/336.3
5,813,261 A * 9/1998 Boehlow ..... E05B 33/00 70/190
6,099,053 A * 8/2000 Huang ..... E05B 17/2084 292/336.3
6,386,602 B1 * 5/2002 Lan ..... E05B 3/065 292/336.3
6,810,703 B1 * 11/2004 Huang ..... E05B 27/0014 70/367
6,857,300 B1 * 2/2005 Heeley ..... E05B 13/004 70/472
7,389,661 B2 * 6/2008 Viviano ..... E05B 55/005 70/190
7,516,633 B1 * 4/2009 Chang ..... E05B 13/101 70/279.1
8,360,489 B2 * 1/2013 Cho ..... E05B 3/065 292/357
2006/0065025 A1 * 3/2006 Viviano ..... E05B 63/04 70/134
2007/0056340 A1 * 3/2007 Boyd ..... E05B 1/0053 70/408
2008/0011028 A1 * 1/2008 Shen ..... E05B 55/005 70/91
2008/0307836 A1 * 12/2008 Kim ..... E05B 3/065 70/91
2012/0235429 A1 * 9/2012 Chen ..... E05B 3/065 292/357
2013/0118218 A1 * 5/2013 Chiou ..... E05B 55/005 70/91
2016/0040454 A1 * 2/2016 Viviano ..... E05B 63/0017 70/129

* cited by examiner

LOCKING DEVICE

TECHNICAL FIELD

The present invention relates to the technical field of locks, and in particular to a locking device.

BACKGROUND

A locking device is a device that functions to close an area and includes a latch, a cylinder and its accessories. Nowadays, in addition to be opened by means of keys, the lock can be unlocked with commands from signals such as light, electricity, magnetism, sound and fingerprint, password, phone APP etc.

Typically, locking of the lock is achieved by inserting a key into a plug of the cylinder to drive a spindle, which then drives the latch by a torque transmitted from the key to the spindle. However, this conventional technique requires a key to apply the torque and realize the locking, which is very troublesome and inconvenient.

Therefore, how to achieve convenient locking has become a technical problem to be solved.

SUMMARY

The technical problem to be solved by the present invention is how to realize convenient locking.

To this end, an embodiment of the present invention provides a locking device comprising: a latch fixed to an object to be locked, for engaging with a bore of a strike; the latch having a bolt is configured to lock the object by moving approaching the bore; a spindle, one end of which being detachably connected to the latch for driving the bolt to move towards or away from the bore; and a rotary assembly disposed at an other end of the spindle, one end of the rotary assembly adjacent to the spindle is provided with a spindle driving means, which is engaged with the other end of the spindle under an external torque to drive the spindle to rotate; wherein the rotary assembly drives the spindle to rotate via the spindle driving means under the external torque, and the spindle drives the latch to move approaching the bore to realize locking.

Optionally, the locking device further comprises: a first limit assembly for limiting a rotary path of the rotary assembly or the spindle to prevent the spindle from releasing the bolt.

Optionally, the locking device further comprises a resetting assembly engaged with the rotary assembly, wherein the resetting assembly force the rotary assembly to restore when the external torque is removed, so that the spindle driving means is disengaged from the other end of the spindle.

Optionally, the locking device further comprises a second limit assembly engaged with the rotary assembly; the second limit assembly limits a circumferential rotary path of the rotary assembly when the resetting assembly is reset, to prevent the rotary assembly from driving the spindle to release the bolt.

Optionally, the rotary assembly comprises a cylinder body disposed at the other end of the spindle for directly receiving the external torque, or detachably connecting with a rotary body for receiving a torque from the rotary body.

Optionally, the rotary assembly further comprises a rotary body detachably connected to the cylinder body, and the rotary body may be configured as a knob, a handle, or a lever, which is convenient for the user to operate.

In some embodiments, the rotary body is provided with a receiving groove extending through opposite end faces thereof into which the cylinder body is insertable.

Optionally, the first limit assembly comprises a limit rotation shaft engaged with the rotary assembly; a position-limiting member rotatably connected to the limit rotation shaft for limiting the circumferential rotation of the limit rotation shaft thereto.

Optionally, the limit rotation shaft comprises a rotation shaft body, and the rotation shaft body is provided with a limit protrusion; the position-limiting member comprises a limit body, and two limit blocks are provided on a sidewall of the limit body for limiting a circumferential rotation of the limit protrusion.

Optionally, the locking device further comprises a cover provided with a fixing post, and the locking device is fixed to the object to be locked by the fixing post; and the second limit assembly is configured as the fixing post.

Optionally, the resetting assembly comprises a toggle block disposed at one end of the rotary assembly, and the toggle block is mounted around the rotary assembly; and a torsion spring disposed at the end of the rotary assembly and at a side of the toggle block adjacent to the rotary assembly, the torsion spring resets the toggle block when the external torque is removed.

Optionally, the toggle block comprises a toggle portion provided with a toggle member, the torsion spring comprises a torsion spring body of a spiral shape and mounted around the rotary assembly, and both ends of the torsion spring body are each provided with a hook, the hook is engaged with a sidewall of the toggle member.

BRIEF DESCRIPTION OF THE DRAWINGS

In order to illustrate technical solutions of the present invention more apparent, the present invention will be further described in detail with reference to the accompanying drawings and the embodiments. It should be understood that the specific embodiments described herein are merely illustrative of the present invention and are not intended to limit the present invention. Modifications and variations of the invention as herein set forth can be made by those skilled in the art without departing from the spirit and scope thereof.

REFERENCE NUMERALS

Figure 1:
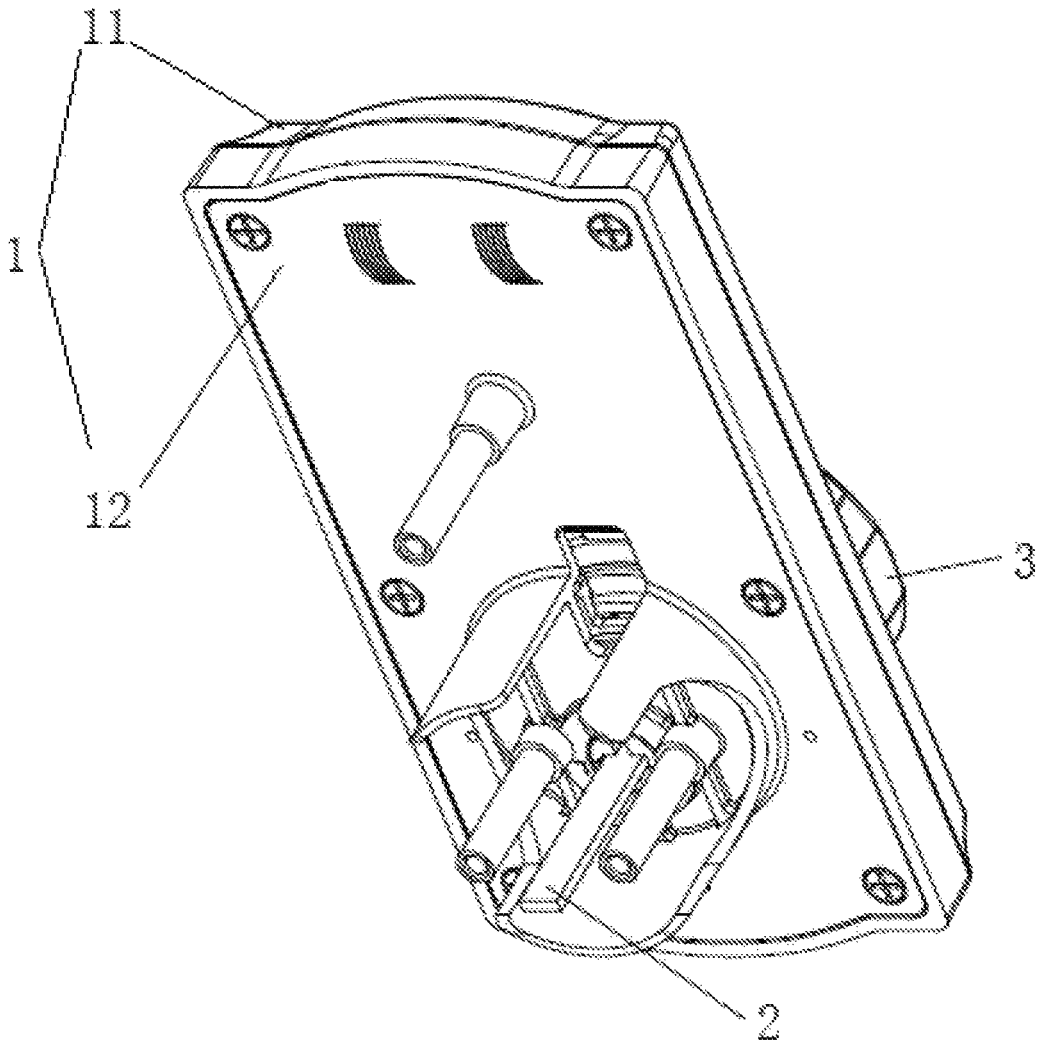
FIG. 1 is an assembled schematic structural view of a locking device according to an embodiment of the present invention.

1 cover, 11 upper cover; 111 through hole; 12 lower cover, 2 spindle; 3 rotary assembly; 31 cylinder body, 311 spindle driving means; 32 rotary body; 321 anti-slip structure; 322 receiving groove; 323 fixing block; 4 resetting assembly; 41 torsion spring, 411 torsion spring body; 412 hook; 42 toggle block; 421 toggle portion; 422 toggle member, 5 first limit assembly; 51 limit rotation shaft; 511 shaft body; 512 limit protrusion; 52 position-limiting member, 521 limit body; 522 limit block; 61 latch; 62 bolt; 7 second limit assembly.

DESCRIPTION OF THE EMBODIMENTS

The present invention will be further described in detail below with reference to the accompanying drawings and embodiments. It is understood that the embodiments described herein are merely illustrative of the invention and are not intended to limit the invention.

In the description of the present invention, it is to be noted that the terms with respect to the orientation or positional relationship, such as "center", "upper", "lower", "left", "right", "vertical", "horizontal", "inside", "outside", etc, indicating the orientation or positional relationship shown in the drawings, and is merely for the convenience of the description of the invention and the simplified description, rather than indicating or implying that the device or assembly referred to has a specific orientation, be constructed or operated in a specific orientation, therefore not to limit the invention. Moreover, the terms "first," "second," and "third" are used for descriptive purposes only and are not to be construed as indicating or implying relative importance.

In the description of the present invention, except where the context requires otherwise explicitly or defination, it should be noted that the terms "installation", "connect", and "engage" are to be understood broadly, and may be fixed or detachable connection, or integral connection; may be mechanical connection or electrical connection; may be directly connected, may also be indirectly connected through an intermediate medium, or may be internal communication of two elements, may be wireless connection, or may be wired connection. The specific meaning of the above terms in the present invention can be understood in the specific embodiments by those skilled in the art.

Further, the technical features involved in the different embodiments of the present invention described below may be combined with each other as long as they do not constitute a conflict with each other.

In order to solve the technical problem of how to realize convenient locking of the lock, the invention provides a locking device. In an embodiment, the locking device may be a mechanical lock or a smart lock. In this context, the expressions "lock the object" and "locking the object" means that after the object has been locked by the lock, it requires a key to unlock the lock.

Figure 2:
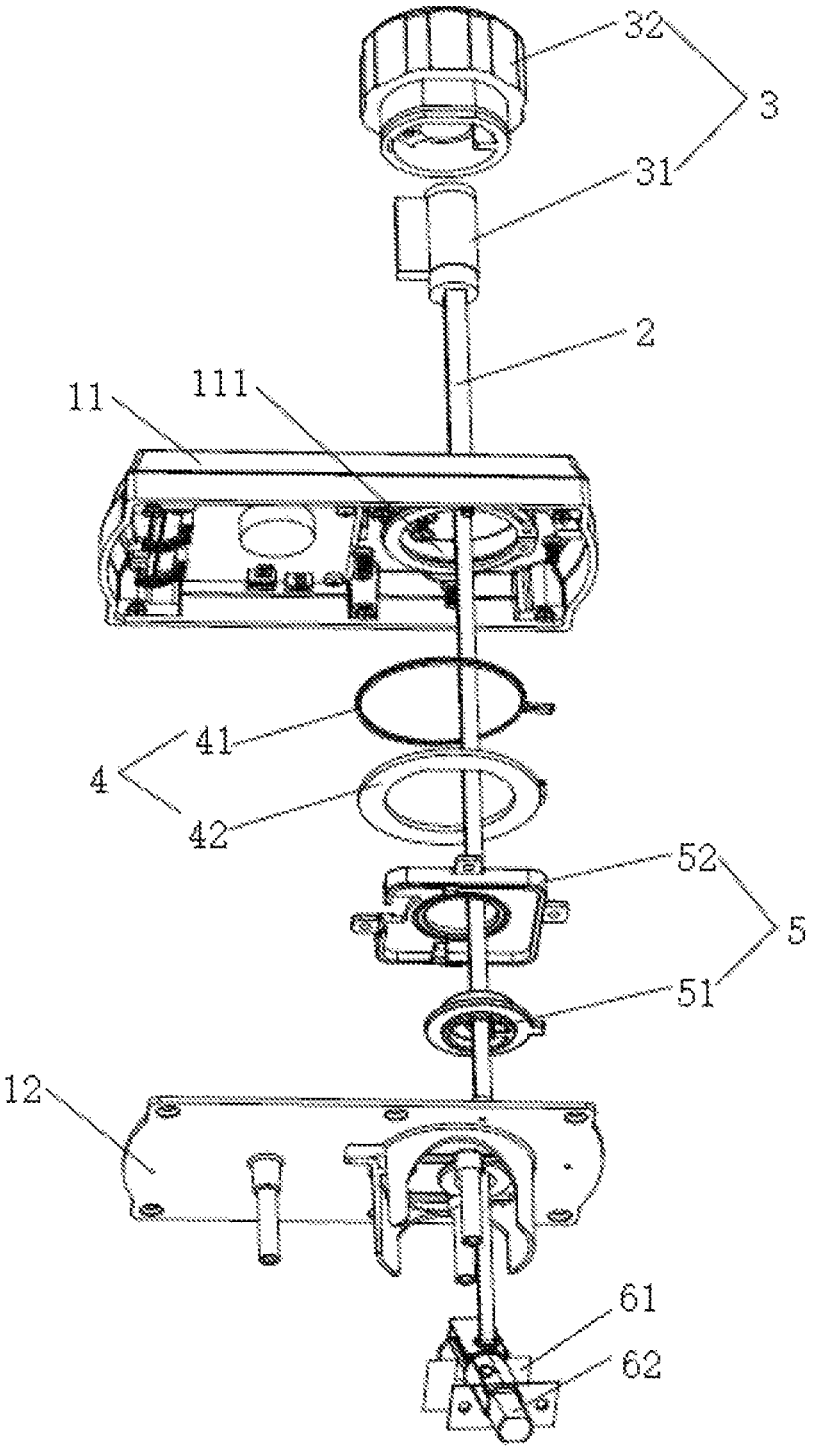
FIG. 2 is an exploded view of the locking device according to the embodiment.

Referring to FIG. 1 and FIG. 2, wherein FIG. 1 is an assembled schematic structural view of a locking device according to an embodiment of the present invention, and FIG. 2 is an exploded view of the locking device according to the embodiment. The lock includes a latch 61, a spindle 2, a rotary assembly 3. The latch 61 includes a bolt 62.

The latch 61 is fixed on the object to be locked, and the bolt 62 of the latch 61 is configured to fit with a bore of a strike. The bolt 62 locks the object to be locked after moving approaching the bore. In this embodiment, the object to be locked is an object capable of moving between a closed state and an open state with respect to a specific reference object. For example, the object to be locked is a door, and the reference object is a door frame.

One end of the spindle 2 is detachably connected to the latch 61. The spindle 2 is configured to drive the bolt 62 of the latch 61 to move toward or away from the bore. During the specific installation process, one end of the spindle 2 can be snapped into the latch 61 so that the bolt 62 of the latch 61 follows the rotation of the spindle 2 and moves towards or away from the bore. Generally, after the installation, one end of the spindle 2 is fixed relative to the latch 61. In this embodiment, detachable connection between the one end of the spindle 2 and the latch 61 is advantageous for convenient installation.

The rotary assembly 3 is disposed at the other end of the spindle 2, and one end of the rotary assembly 3 facing the spindle 2 is provided with a spindle driving means 311, which is able to be engaged with the other end of the spindle 2 to drive the spindle 2 to rotate under an external torque. In specific embodiments, the spindle driving means 311 may be disposed inside the rotary assembly 3, may be disposed outside the rotary assembly 3, or may be disposed on the end surface of the rotary assembly 3.

Figure 3:
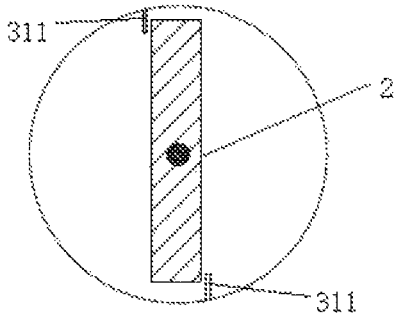
FIG. 3 is a schematic structural view showing a connection structure of the spindle and the spindle driving means according to a first embodiment.
Figure 4:
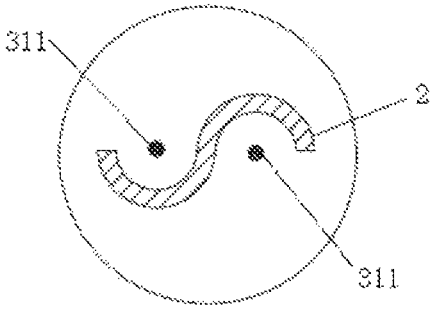
FIG. 4 is a schematic structural view showing a connection structure of the spindle and a spindle driving means according to a second embodiment.
Figure 5:
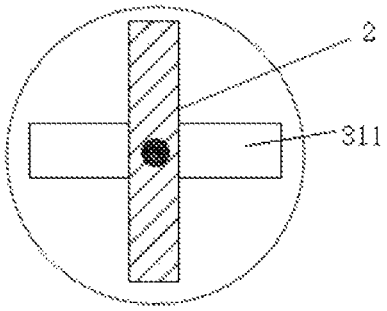
FIG. 5 is a schematic structural view showing a connection structure of the spindle and the spindle driving means according to a third embodiment.

In case that the spindle driving means 311 is disposed inside the rotary assembly 3, the spindle driving means 311 can be disposed at an inner circumference of the rotary assembly 3. Further, the present disclosure does not limit the connection manner between the spindle 2 and the rotary assembly 3, the spindle 2 and the rotary assembly 3 may be detachably connected or undetachable connected, as long as one end of the spindle 2 is able to be driven with lost motion within a certain angle in the rotary assembly 3, that is, after the rotary assembly 3 is rotated by a certain angle in a predetermined direction or in the reverse direction, the spindle driving means 311 in the rotary assembly 3 starts to contact the other end of the spindle 2. It should be noted that the spindle driving means 311 may be a pair or a single one. Referring to FIG. 3, FIG. 4 and FIG. 5, wherein FIG. 3 is a schematic view structural showing the connection structure of the spindle and the spindle driving means 311 according to a first embodiment. The spindle driving means 311 is provided in a pair inside the rotary assembly 3. The rotation of the rotary assembly 3 drives the spindle driving means 311 to engage with the spindle 2, and then drives the spindle 2 to rotate. FIG. 4 is a schematic structural view showing a connection structure of the spindle and a spindle driving means 311 according to a second embodiment, wherein the spindle driving means 311 are provided in a pair inside the rotary assembly 3 and driven by the rotary assembly 3 as it rotates to engage with the spindle 2, and then drive the spindle 2 to rotate. FIG. 5 is a schematic structural view showing a connection structure of the spindle and the spindle driving means 311 according to a third embodiment. The spindle driving means 311 is disposed on the end surface of the rotary assembly 3, and the rotary assembly 3 drives the spindle driving means 311 to engage with the spindle 2 as it rotates, and then drives the spindle 2 to rotate. The spindle 2 serves as an object for transmitting torque.

Figure 6:
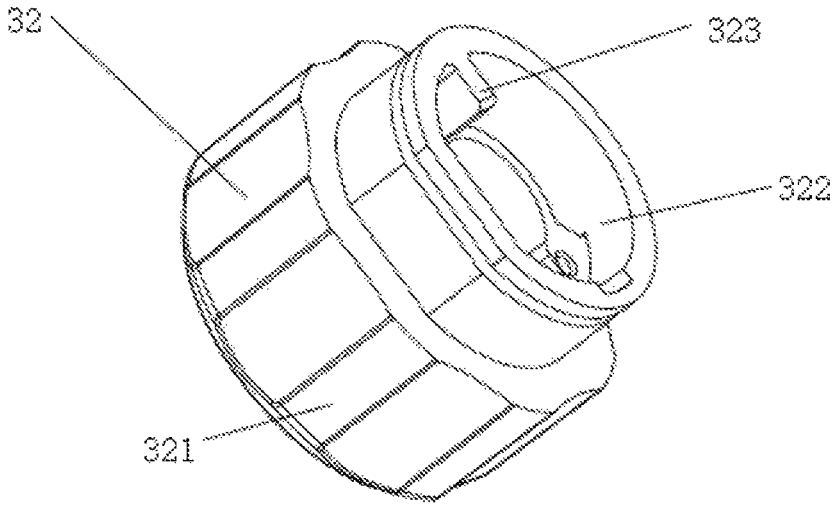
FIG. 6 is a schematic structural view of a rotary body according to an embodiment.

In one embodiment, referring to FIG. 2 and FIG. 6, the rotary assembly 3 includes: a cylinder body 31 and a rotary body 32. The cylinder body 31 is disposed at one end of the spindle 2, and the cylinder body 31 is configured to fit with a key. The spindle driving means 311 is provided at one end of the cylinder body 31 facing the spindle, and the spindle driving means 311 is configured to be engaged with the other end of the spindle to drive the spindle to rotate under the external torque. The cylinder body 31 and the spindle 2 are detachably connected. The rotary body 32 is provided at one end of the cylinder body 31. The rotary body 32 is provided with a receiving groove 322 extending through opposite end faces thereof into which the cylinder body 31 is insertable. The outer periphery of the rotary body 32 is provided with anti-slip structure 321. In an embodiment, the rotary body 32 may be configured as a knob, additionally or alternatively, the rotary body 32 may be provided with a handle or a lever which is convenient for a user to operate, but in the present invention, the specific structure of the rotary body 32 is not limited.

It should be noted that, under the external torque, the cylinder body 31 is rotated by the rotary body 32 as it rotates, thereby causing the movement of the spindle 2, and accordingly the bolt 62 of the latch 61 is driven to move approaching the bore by the torque transmitted by the spindle 2 to lock the object to be locked. The anti-slip structure 321 with an anti-slipping function is convenient for operation.

According to the lock disclosed in the above embodiment, the latch 61 and the rotary assembly 3 are connected by the spindle 2, and the torque provided by the rotary assembly 3 is transmitted to the bolt 62 through the spindle 2 so that the bolt 62 can be locked by the cooperation of the rotary assembly 3 and the spindle 2. Under the external torque, the spindle driving means 311 of the rotary assembly 3 is engaged with the other end of the spindle 2. And the rotary assembly 3 can rotate continuously under a continuous external torque, so that the spindle driving means 311 in turn drives the spindle 2 to rotate. Then, the bolt 62 of the latch 61 would be driven to move approaching the bore through the torque transmitted by the spindle 2, to complete the locking operation, thereby realizing the convenient locking of the lock.

In an embodiment, as shown in FIG. 2, the lock further includes a cover 1. In a specific embodiment, the cover 1 may include an upper cover 11 and a lower cover 12 detachably connected with each other. Specifically, the upper cover 11 and the lower cover 12 may be connected by screws. The upper cover 11 is provided with a through hole 111 for plug-in fitting with the rotary assembly 3.

By means of the fixed connection between the upper cover 11 and the lower cover 12, the latch 61, the spindle 2 and the rotary assembly 3 are installed in the cover 1 to make the locking device as a unity which is convenient to lock the object to be locked.

In a specific embodiment, referring to FIG. 2, the lock further includes a first limit assembly 5 for limiting the circumferential rotation of the rotary assembly 3 or the spindle 2, to prevent the rotary assembly 3 from driving the spindle 2 to release the locking of the latch 61. The first limit assembly 5 may be disposed on the rotary assembly 3, maybe disposed on the spindle 2, or may be disposed on the cover 1.

Figure 8:
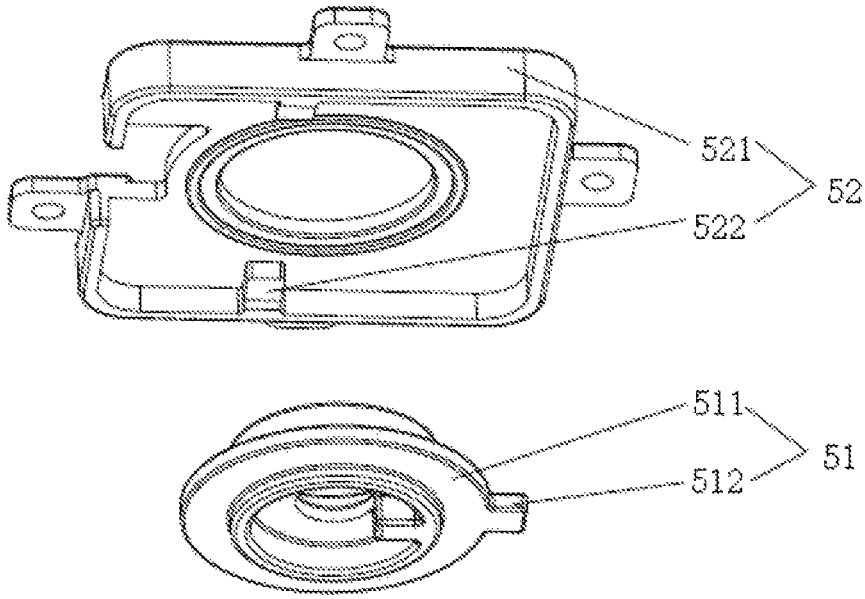
FIG. 8 is an exploded schematic view of a limit assembly according to an embodiment.

Specifically, in an embodiment, as shown in FIG. 8, the first limit assembly 5 includes a limit rotation shaft 51 and a position-limiting member 52. The limit rotation shaft 51 is provided with an opening (not shown), into which the fixing block 323 (referring to FIG. 6) provided on the rotary body 32 is engaged. The position-limiting member 52 is configured to limit the circumferential rotation of the limiting shaft 51 relative thereto.

In one embodiment, as shown in FIG. 8, the limit rotation shaft 51 includes a rotation shaft body 511, which is provided with a limit protrusion 512. The limit protrusion 512 and the rotation shaft body 511 are integrally formed as one piece. The position-limiting member 52 includes a limit body 521 which has at least one limit block 522 at an inner sidewall for limiting the circumferential rotation of the limit protrusion 512. The limit block 522 and the limit body 521 are integrally formed as one piece.

It should be noted that, in the process of locking the lock, the limit block 522 functions to limit the position of the limit protrusion 512. When the rotary body 32 is driven to rotate by the external torque, the limit protrusion 512 abuts the limit block 522, which prevents the rotary body 32 from rotating excessively and causing release of the lock.

In another embodiment, the first limit assembly 5 may also function to limit the reverse rotation of the rotary assembly 3. For example, when the rotary assembly 3 continuously rotates under the continuous external torque in clockwise direction, the spindle 2 is driven to rotate by the spindle driving means 311, and then the bolt 62 of the latch 61 is driven to move approaching the bore by the torque transmitted by the spindle 2 to achieve the locking operation. In the meantime, the first limit assembly 5 prevents the rotary assembly 3 from being subjected to the external torque in the counterclockwise direction, which results in rotation of the rotary assembly 3 in counterclockwise direction, thereby preventing the rotary assembly 3 from rotating in the reverse direction which would cause release of the locking.

In the case that the first limit assembly 5 is disposed on the cover 1, the cover 1 is provided with a seat (not shown) for mounting the position-limiting member, and the position-limiting member 52 of the first limit assembly 5 is fixed via the seat (not shown in the figures). The seat (not shown) may be provided on the upper cover 11 or on the lower cover 12. In case that the seat is providing on the upper cover 11, the limit rotation shaft 51 is fixed between the seat and the upper cover 11. In case that the seat is provided on the lower cover 12, the limit rotation shaft 51 is fixed between the seat and the lower cover 12.

In one embodiment, referring to FIG. 2, the lock further includes a resetting assembly 4. The resetting assembly 4 is detachably connected to the rotary assembly 3, and functions to force the rotary assembly 3 to restore when the external torque is removed, so that the spindle driving means 311 of the cylinder body 31 is disengaged from the other end of the spindle 2.

Figure 7:
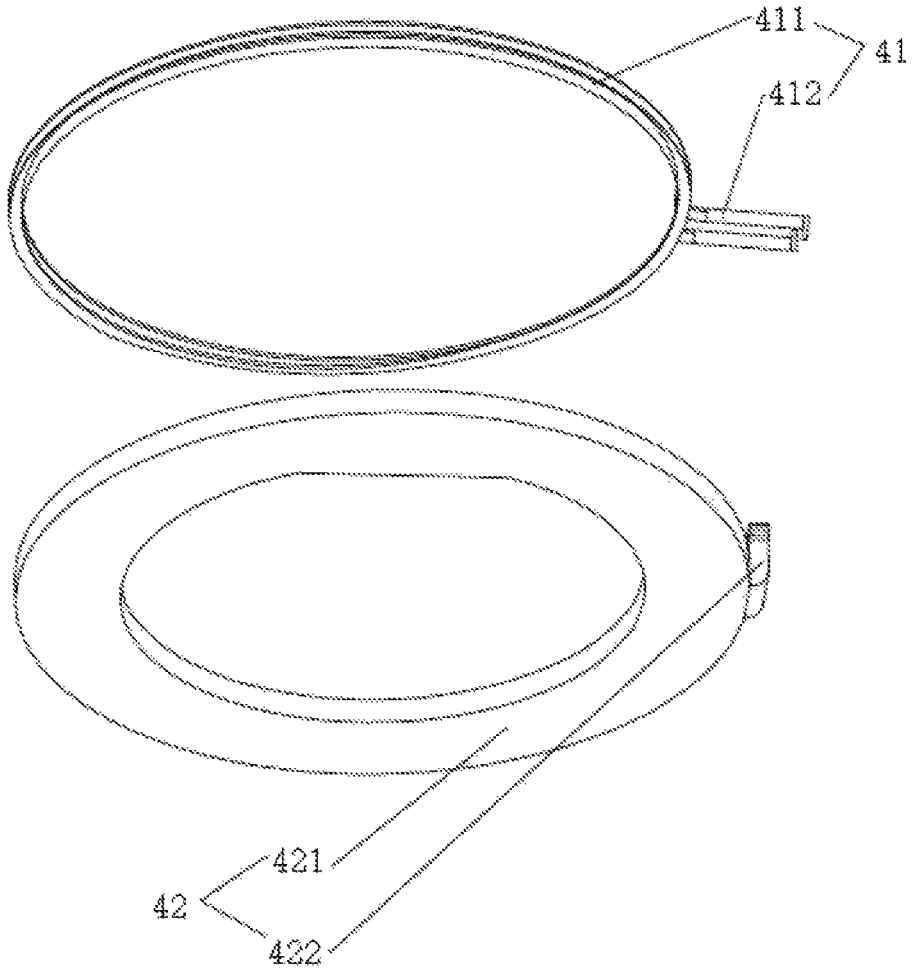
FIG. 7 is an exploded schematic view of a reset assembly according to an embodiment.

Specifically, in an embodiment, referring to FIG. 7, the resetting assembly 4 includes a toggle block 42, and a torsion spring 41 for resetting the toggle block 42. The toggle block 42 is mounted around one end of the rotary body 32 through an annular groove provided on the rotary body 32. The torsion spring 41 is disposed at one end of the rotary body 32 and at a side of the toggle block 42 adjacent to the rotary body 32. The torsion spring 41 is engaged with the toggle block 42 and the torsion spring 41 is in a natural state. In an embodiment, the toggle block 42 may be integrally formed with the rotary body 32 as one piece, and alternatively the toggle block 42 may also be fixedly connected to the rotary body 32 after separately manufactured.

In other embodiments, the resetting assembly 4 can also realize the resetting function in other ways, such as an extendable cord.

In an embodiment, the lock further includes a second limit assembly 7. According to the disclosure, the connection manner between the second limit assembly 7 and the rotary assembly 3 is not limited. The second limit assembly 7 and the rotary assembly 3 may be detachable connection or undetachable connection. The second limit assembly 7 is configured to limit the circumferential rotation path of the rotary assembly 3 when the resetting assembly 4 is operating, so as to prevent the rotary assembly 3 from driving the spindle 2 to release the locking.

It should be noted that, in this embodiment, the second limit assembly 7 and the first limit assembly 5 may have the same structure, and further, the first limit assembly 5 and the second limit assembly 7 may refer to a same structure when they both function to limit the rotary assembly 3 to rotate reversely, that is, when they both function to prevent the rotary assembly 3 from rotating in a direction opposite to that driven by the external torsion.

Figure 9A:
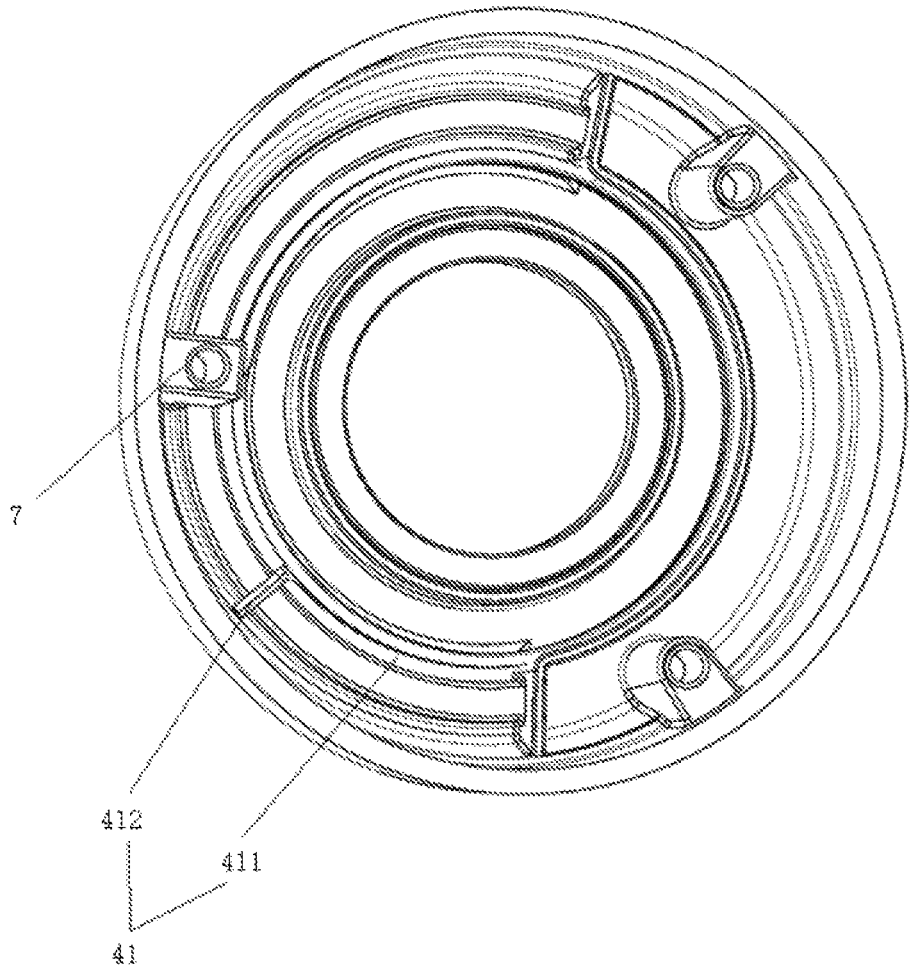
FIG. 9*a* is an assembled view of a limit assembly and a resetting assembly according to an alternative embodiment.

In another embodiment, the cover 1 is further provided with a fixing post for fixing the cover 1 to the object to be locked. In an embodiment, the fixing post may be a threaded post. As shown in FIG. 9*a*, the second limit assembly 7 can be a threaded post. In this embodiment, the hooks 412 at two ends of the torsion spring body 411 are respectively disposed on two sides of the threaded post, and the threaded post functions to limit the rotation of the hook 412. When the torsion spring 41 drives the rotary body 32 to restore, the hook 412 is engaged with the threaded post to prevent the torsion spring 41 from excessive springback.

Under the external torque, the cylinder body 31 is rotated by the rotary body 32 as it rotates, driving the spindle 2 to move, and the bolt 62 of the latch 61 is driven by the torque transmitted by the spindle 2 to move approaching the bore. In the meantime, the toggle block 42 compresses the torsion spring 41. After the external torque is removed, the torsion spring 41 drives the toggle block 42 and the rotary body 32 to restore, and the spindle driving means 311 of the cylinder body 31 is disengaged from the other end of the spindle 2. The second limit assembly 7 limits the circumferential rotation of the cylinder body 31 when the resetting assembly 4 forces the cylinder body 31 to restore, so that the other end of the spindle 2 is free in the cylinder body 31 without contacting the spindle driving means 311, as a result, the spindle driving means 311 of the cylinder body 31 is prevented from moving reversely and being engaged with the other end of the spindle 2, thereby preventing the cylinder body 31 from driving the spindle 2 to release the bolt 62, and thus achieve locking the object to be locked.

In one embodiment, as shown in FIG. 7, the toggle block 42 includes a toggle portion 421 provided with a toggle member 422, and the toggle member 422 and the toggle portion 421 are integrally formed as one piece. The torsion spring 41 includes a torsion spring body 411 that is mounted around the rotary body 32 (referring to FIG. 2). The torsion spring body 411 has a spiral shape. Both ends of the torsion spring body 411 are each provided with a hook 412 which is engaged with the outer side wall of the toggle member 422 The hook 412 and the torsion spring body 411 are integrally formed as one piece.

It should be noted that, under the external torque, the cylinder body 31 is rotated by the rotary body 32, thereby driving the spindle 2 to move, and the latch 61 is driven to move by the torque transmitted by the spindle 2. The bolt 62 of latch 61 is moved towards the bore, the toggle block 42 drives the hook 412 to move through the toggle member 422, thereby compressing the torsion spring 41. After the external torque is removed, the torsion spring 41 drives the toggle block 42 and the rotary body 32 to restore. The bolt 62 of the latch 61 is engaged in the bore, thereby locking the object to be locked.

According to the locking device of the above embodiment, the resetting assembly 4 is detachably connected to the rotary assembly 3, the resetting assembly 4 would generate an elastic force under the toque provided by the rotary assembly 3 and an elastic energy is stored. When external torque is removed, the resetting assembly 4 would release the stored elastic potential energy, and the rotary assembly 3 is restored to the initial position, and the spindle driving means 311 of the rotary assembly 3 is disengaged from the other end of the spindle 2. The limit assembly 5 limits the circumferential rotation path of the rotary assembly 3 when the resetting assembly 4 resets the rotary assembly 3, so that the other end of the spindle 2 is free in the rotary assembly 3, and the reverse engagement between the other end of the spindle 2 and the spindle driving means 311 in the rotary assembly 3 is avoided, thereby preventing the rotary assembly 3 from driving the spindle 2 to release the bolt 62 of the latch 61, and thus the problem that the lock is released due to excessive rotation of the rotary assembly 3 is solved. As a result, failure to lock the door due to the excessive restore path of rotary assembly 3 is avoided.

In some embodiments, the toggle block 42 may also function as a position limit element. For example, the toggle member 422 or another structure such as at least one protrusion may be provided and engaged with a fixed structure after the toggle block 42 has been rotated by a certain degree.

In some embodiments, the torsion spring 41 may also function as a position limit element, which is achieved by limiting the length of the torsion spring body 411, as a result, the toggle block 42 cannot rotate any more when the torsion spring body 411 has been compressed to its extreme by its length.

Figure 9B:
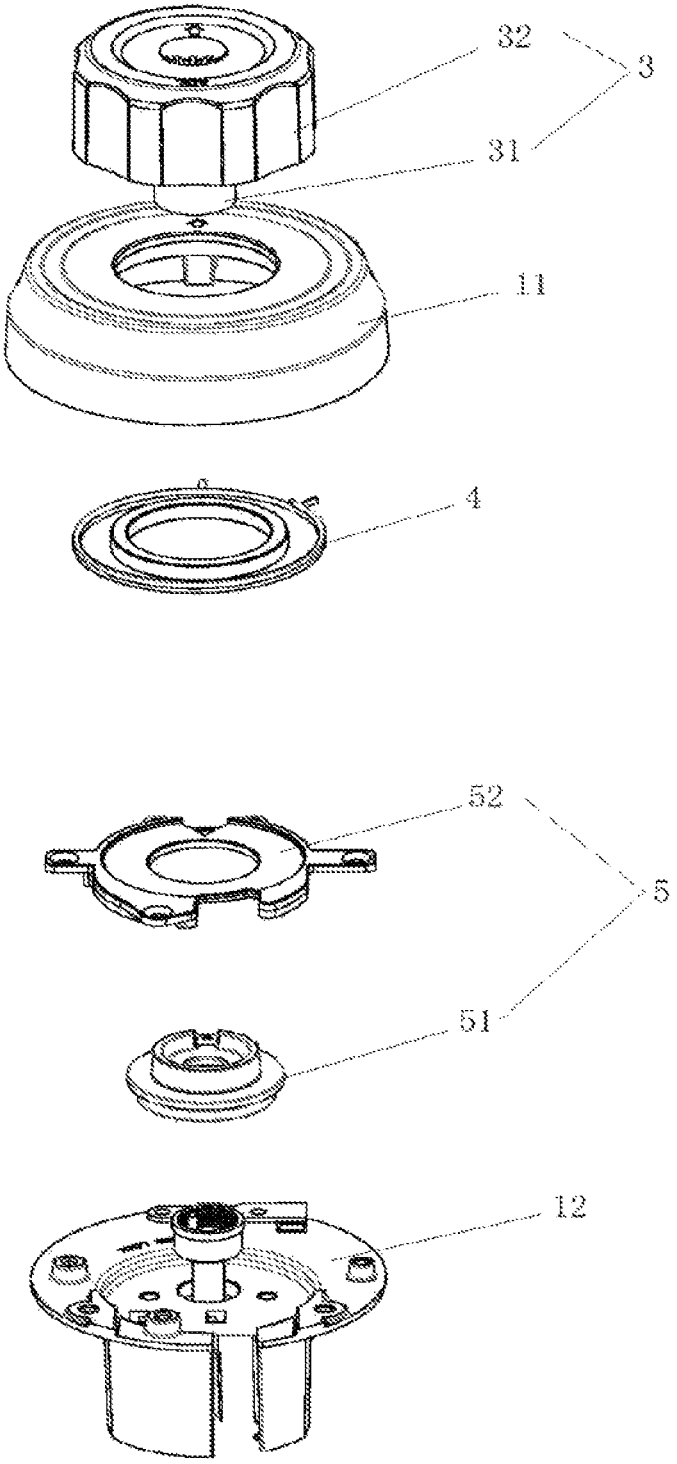
FIG. 9*b* is an exploded schematic view of the locking device according to a further embodiment.

In another embodiment, referring to FIG. 9*a*, which is an exploded schematic view of a limit assembly and a restoing assembly according to an alternative embodiment, the lock structures described in the above embodiment can also be applied to a circular lock as shown in FIG. 9*b*.

It is apparent that the above-described embodiments are merely illustrative of the examples, and are not intended to limit the embodiments. Other variations or modifications of the various forms may be made by those skilled in the art in light of the above description. There is no need and no way to exhaust all of the embodiments. Apparent changes or variations resulting therefrom are still within the scope of the invention.

What is claimed is:

1. A locking device, comprising:

a lock having a bolt that is movable in a locking position and a release position;

an elongated spindle having opposing first and second axial ends, the first axial end being detachably connected to the bolt for driving the bolt to move;

a rotary assembly having an axial outer end and an opposite axial inner end, the rotary assembly comprising a rotatable cylinder body, and a rotary body connected to the cylinder body and configured to drive the cylinder body to rotate, wherein the second axial end of the spindle is connected to a central portion of the cylinder body at the axial inner end of the rotary assembly;

a fixed position-limiting member located adjacent to the second axial end of the spindle, the position-limiting member comprising at least one limit block, the at least one limit block protrudes towards the first axial end of the spindle;

a rotatable limit rotation member located adjacent to the position-limiting member, the limit rotation member comprising a rotation body, and a limit protrusion extending radially outwardly from the rotation body, the spindle being extending through a central opening of the rotation body, and a circumferential position of the limit protrusion is limited by the at least one limit block by abutting against each other when the limit rotation member rotates relative to the position-limiting member, and a resetting assembly engaged with the rotary assembly, wherein the rotary assembly further comprises a spindle driving member which drives the second axial end of the spindle to move under rotation of the rotary assembly, wherein under an external torque directly applied on the rotary body, the rotary body rotates in a first direction and drives the spindle to rotate in the first direction by means of the spindle driving member, and the spindle rotating in the first direction in turn drives the bolt to move to the locking position, and when the rotary body rotates in a second direction opposite to the first direction, the spindle is undrivable by the rotary body rotating in the second direction and thus the bolt is maintained in the locking position, and wherein the resetting assembly forces the rotary assembly to restore when the external torque is removed, so that the spindle driving member is disengaged from the second axial end of the spindle.

2. The locking device according to claim 1, further comprising:

a second limit assembly, wherein the second limit assembly limits a circumferential rotary path of the rotary assembly when the resetting assembly is resetting, to prevent the rotary assembly from driving the spindle to release the bolt.

3. The locking device according to claim 2, wherein the second limit assembly comprises a base plate and at least one limit member that protrudes from the base plate in a direction axially opposite from the rotary body.

4. The locking device according to claim 3, further comprising:

a torsion spring comprising a torsion spring body disposed around the periphery of the rotary body, and two hooks that extend radially outward from the torsion spring body, the two hooks are disposed on two sides of the limit member, and a toggle block fixedly disposed at the axial inner end of the rotary assembly, and the toggle block is mounted around the rotary body; the toggle block comprises a toggle portion provided with a toggle member, and each hook is engageable with a side wall of the toggle member.

5. The locking device according to claim 1, wherein the rotary body is configured as a knob, a handle or a lever.

6. The locking device according to claim 1, wherein the rotary body is provided with a receiving groove extending through opposite end faces thereof into which the cylinder body is insertable.

7. The locking device according to claim 1, wherein the resetting assembly comprises:

a toggle block disposed at the axial inner end of the rotary assembly, and the toggle block is mounted around the rotary assembly; and a torsion spring disposed at the axial inner end of the rotary assembly and at a side of the toggle block adjacent to the rotary assembly, wherein the torsion spring resets the toggle block when the external torque is removed.

8. The locking device according to claim 7, wherein the toggle block comprises a toggle portion provided with a toggle member, the torsion spring comprises a torsion spring body of a spiral shape and mounted around the rotary assembly, both ends of the torsion spring body each provided with a hook, and the hooks are engaged with side walls of the toggle member.

* * * * *